US007592299B2

(12) United States Patent
Chambard et al.

(10) Patent No.: US 7,592,299 B2
(45) Date of Patent: Sep. 22, 2009

(54) DETERGENT

(75) Inventors: Laurent Chambard, Englewood, NJ (US); Dominique Moulin, Notre Dame de Gravenchon (FR)

(73) Assignee: Infineum International Limited (GB)

( * ) Notice: Subject to any disclaimer, the term of this patent is extended or adjusted under 35 U.S.C. 154(b) by 46 days.

(21) Appl. No.: 11/429,881

(22) Filed: May 8, 2006

(65) Prior Publication Data

US 2006/0258550 A1 Nov. 16, 2006

(30) Foreign Application Priority Data

May 10, 2005 (EP) ..... 05270014

(51) Int. Cl.
*C10M 1/40* (2006.01)

(52) U.S. Cl. ..... 510/127; 252/33.2; 252/33.3

(58) Field of Classification Search ..... 510/285; 508/391, 393, 460, 574, 586
See application file for complete search history.

(56) References Cited

U.S. PATENT DOCUMENTS

| | | | | | |
|---|---|---|---|---|---|
| 4,206,062 | A | * | 6/1980 | Derbyshire et al. | 508/397 |
| 5,164,102 | A | * | 11/1992 | Everett et al. | 508/192 |
| 6,107,259 | A | * | 8/2000 | Muir et al. | 508/393 |
| 6,153,565 | A | * | 11/2000 | Skinner et al. | 508/391 |
| 6,191,081 | B1 | | 2/2001 | Cartwright et al. | 508/460 |
| 6,239,084 | B1 | | 5/2001 | Eliades et al. | 508/398 |
| 2005/0101494 | A1 | * | 5/2005 | Iyer et al. | 508/192 |

* cited by examiner

*Primary Examiner*—Mark Eashoo
*Assistant Examiner*—M. Reza Asdjodi

(57) ABSTRACT

A high base number calcium sulphonate detergent having a total soap/BN ratio of 0.0530 to 0.0585, preferably 0.0540 to 0.0580, more preferably 0.0550 to 0.0575. The calcium sulphonate detergent has a base number of greater than 350 mg KOH/g as measured by ASTM D 2896-98. The high base number sulphonate exhibits reduced viscosity drift, improved stability and improved catalytic oxidation.

13 Claims, No Drawings

DETERGENT

The present invention concerns an improved detergent. In particular, the present invention concerns an improved high base number calcium sulphonate detergent.

When stored over time, and particularly at elevated temperatures, high base number calcium sulphonate detergents suffer from viscosity drift, which is when the viscosity of the detergent increases. Thus, after a period of time, the viscosity of the detergent may no longer be within the required specification and, also, if the viscosity of the detergent is too high, the detergent may no longer be suitable for blending and for use in a lubricating oil.

U.S. Pat. No. 6,239,084B teaches the use of post addition of alkyl phenol to prevent viscosity drift.

The aim of the present invention is to provide an improved detergent. A further aim of the present invention is to provide a high base number calcium sulphonate detergent that exhibits reduced viscosity drift.

In accordance with the present invention, there is provided a calcium sulphonate detergent having a total soap/BN ratio of 0.0530 to 0.0585, preferably 0.0540 to 0.0580, more preferably 0.0550 to 0.0575, and a total base number of greater than 350, preferably greater than 400, and most preferably greater than 420, mg KOH/g as measured by ASTM D 2896-98; the calcium sulphonate detergent being prepared from a surfactant system that includes greater than 70%, preferably greater than 80%, more preferably greater than 90%, and most preferably greater than 95%, of sulphonic acid.

The inventors have found that by controlling the ratio of total soap to base number, they are able to reduce the viscosity drift of a high base number calcium sulphonate detergent prepared from a surfactant system including greater than 70% of sulphonic acid. The inventors have also found that the calcium sulphonate detergents in accordance with the present invention exhibit improved stability in a lubricating oil and improved catalytic oxidation.

In accordance with the present invention there is also provided a method of reducing the viscosity drift of a calcium sulphonate detergent, the method including the step of controlling the total soap and base number of the detergent so that the total soap/base number is 0.0530 to 0.0585, preferably 0.0540 to 0.0580, more preferably 0.0550 to 0.0575; the calcium sulphonate detergent having a total base number of greater than 350, preferably greater than 400, and most preferably greater than 420, mg KOH/g as measured by ASTM D 2896-98; the calcium sulphonate detergent being prepared from a surfactant system that includes greater than 70%, preferably greater than 80%, more preferably greater than 90%, and most preferably greater than 95%, of sulphonic acid.

By 'total soap' we mean the per cent by weight of sulphonate present in the calcium sulphonate detergent.

Overbased calcium sulphonate detergents are formed from a mixture of a sulphonic acid, a hydrocarbon solvent, an alcohol, water and a stoichiometric excess of a calcium compound (preferably calcium hydroxide) above that required to react with the sulphonic acid. The mixture is overbased (carbonated) with an overbasing agent which provides a source of base.

The process involves adding the reagents to a reactor and injecting the overbasing agent into the reactor until all of the metal compound has been carbonated.

Examples of suitable overbasing agents are carbon dioxide, a source of boron (for example, boric acid), sulphur dioxide, hydrogen sulphide, and ammonia. Preferred overbasing agents are carbon dioxide or boric acid, or a mixture of the two. The most preferred overbasing agent is carbon dioxide and, for convenience, the treatment with overbasing agent will in general be referred to as "carbonation". Unless the context clearly requires otherwise, it will be understood that references herein to carbonation include references to treatment with other overbasing agents.

Advantageously, on completion of the carbonation step, part of the basic metal compound remains uncarbonated. Advantageously, up to 15 mass % of the basic calcium compound remains uncarbonated, especially up to 11 mass %.

Carbonation is effected at less than 100° C. Typically the carbonation is effected at at least 15° C., preferably at least 25° C. Advantageously, carbonation is carried out at less than 80° C., more advantageously less than 60° C., preferably at most 50° C., more preferably at most 40° C., and especially at most 35° C.

Advantageously, the temperature is maintained substantially constant during the carbonation step, with only minor fluctuations. Where there is more than one carbonation step, both or all carbonation steps are preferably carried out at substantially the same temperature, although different temperatures may be used, if desired, provided that each step is carried out at less than 100° C.

Carbonation may be effected at atmospheric, super-atmospheric or sub-atmospheric pressures. Preferably, carbonation is carried out at atmospheric pressure.

Advantageously, the carbonation step is followed by a "heat-soaking" step in which the mixture is maintained, without addition of any further chemical reagents, in a selected temperature range (or at a selected temperature), which is normally higher than the temperature at which carbonation is effected, for a period before any further processing steps are carried out. The mixture is normally stirred during heat-soaking. Typically, heat-soaking may be carried out for a period of at least 30 minutes, advantageously at least 45 minutes, preferably at least 60 minutes, especially at least 90 minutes. Temperatures at which heat-soaking may be carried out are typically in the range of from 15° C. to just below the reflux temperature of the reaction mixture, preferably 25° C. to 60° C.: the temperature should be such that substantially no materials (for example, solvents) are removed from the system during the heat-soaking step. We have found that heat-soaking has the effect of assisting product stabilization, dissolution of solids, and filtrability.

Preferably, following the carbonation step (and the heat-soaking step, if used), a further quantity of basic calcium compound is added to the mixture and the mixture is again carbonated, the second carbonation step advantageously being followed by a heat-soaking step.

Products of reduced viscosity may be obtained by employing one or more further additions of basic calcium compound and subsequent carbonation, each carbonation step advantageously being followed by a heat-soaking step. Basic calcium compounds include calcium oxide, hydroxide, alkoxides, and carboxylates. Calcium oxide and, more especially, hydroxide are preferably used. A mixture of basic compounds may be used, if desired.

The mixture to be overbased by the overbasing agents should normally contain water, and may also contain one or more solvents, promoters or other substances commonly used in overbasing processes.

Examples of suitable solvents are aromatic solvents, for example, benzene, alkyl-substituted benzenes, for example, toluene or xylene, halogen-substituted benzenes, and lower alcohols (with up to 8 carbon atoms). Preferred solvents are toluene and/or methanol. The amount of toluene used is advantageously such that the percentage by mass of toluene, based on the calcium overbased detergent (excluding oil) is at least 1.5, preferably at least 15, more preferably at least 45, especially at least 60, more especially at least 90. For practical/economic reasons, the said percentage of toluene is typically at most 1200, advantageously at most 600, preferably at most 500, especially at most 150. The amount of methanol used is advantageously such that the percentage by mass of methanol, based on the calcium detergent (excluding oil) is at least 1.5, preferably at least 15, more preferably at least 30, especially at least 45, more especially at least 50. For practical/economic reasons, the said percentage of methanol (as solvent) is typically at most 800, advantageously at most 400, preferably at most 200, especially at most 100. The above percentages apply whether the toluene and methanol are used together or separately.

Preferred promoters are methanol and water. The amount of methanol used is advantageously such that the percentage by mass of methanol, based on the initial charge of basic calcium compound(s), for example, calcium hydroxide (that is, excluding any basic calcium compound(s) added in a second or subsequent step) is at least 6, preferably at least 60, more preferably at least 120, especially at least 180, more especially at least 210. For practical/economic reasons, the said percentage of methanol (as promoter) is typically at most 3200, advantageously at most 1600, preferably at most 800, especially at most 400. The amount of water in the initial reaction mixture (prior to treatment with the overbasing agent) is advantageously such that the percentage by mass of water, based on the initial charge of basic calcium compound(s), for example, calcium hydroxide, (that is, excluding any basic calcium compound(s) added in a second or subsequent step) is at least 0.1, preferably at least 1, more preferably at least 3, especially at least 6, more especially at least 12, particularly at least 20. For practical/economic reasons, the said percentage of water is typically at most 320, advantageously at most 160, preferably at most 80, especially at most 40. If reactants used are not anhydrous, the proportion of water in the reaction mixture should take account of any water in the components and also water formed by neutralization of the surfactants. In particular, allowance must be made for any water present in the surfactants themselves.

Advantageously, the reaction medium comprises methanol, water (at least part of which may be generated during salt formation), and toluene.

If desired, low molecular weight carboxylic acids (with 1 to about 7 carbon atoms), for example, formic acid, inorganic halides, or ammonium compounds may be used to facilitate carbonation, to improve filtrability, or as viscosity agents for overbased detergents.

The overbased detergents are preferably free from inorganic halides, ammonium salts, dihydric alcohols or residues thereof.

For ease of handling, the overbased detergent advantageously has a $KV_{40}$ of at most 20,000 $mm^2/s$, preferably at most 10,000 $mm^2/s$, especially at most 5,000 $mm^2/s$, and a $KV_{100}$ of at most 2,000 $mm^2/s$, preferably at most 1,000 $mm^2/s$, especially at most 500 $mm^2/s$. Throughout this specification, viscosities are measured in accordance with ASTM D445.

The calcium sulphonate detergent is prepared from a surfactant system that includes greater than 70%, preferably greater than 80%, more preferably greater than 90%, and most preferably greater than 95%, of sulphonic acid. The other surfactants may, for example, be phenol, salicylic acid and/or carboxylic acid. Preferably, the overbased calcium sulphonate detergent includes sulphonic acid as the only surfactant.

Sulphonic acids are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from about 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from about 7 to about 100 or more carbon atoms. They preferably contain from about 16 to about 80 carbon atoms, or 12 to 40 carbon atoms, per alkyl-substituted aromatic moiety, depending on the source from which they are obtained.

When neutralizing these alkylaryl sulphonic acids to provide sulphonates, hydrocarbon solvents and/or diluent oils may also be included in the reaction mixture, as well as promoters and viscosity control agents.

Another type of sulphonic acid which may be used comprises alkyl phenol sulphonic acids. Such sulphonic acids can be sulphurized. Whether sulphurized or non-sulphurized these sulphonic acids are believed to have surfactant properties comparable to those of sulphonic acids, rather than surfactant properties comparable to those of phenols.

Sulphonic acids suitable for use in accordance with the invention also include alkyl sulphonic acids. In such compounds the alkyl group suitably contains 9 to 100 carbon atoms, advantageously 12 to 80 carbon atoms, especially 16 to 60 carbon atoms.

Where a surfactant is used in the form of a salt, any suitable cation may be present, for example, a quaternary nitrogenous ion, or, preferably, a metal ion. Suitable metal ions include those of alkali metals, alkaline earth metals (including magnesium) and transition metals. Examples of suitable metals are lithium, potassium, sodium, magnesium, calcium, barium, copper, zinc, and molybdenum. Preferred metals are lithium, potassium, sodium, magnesium and calcium, more preferably lithium, sodium, magnesium and calcium, especially calcium. Neutralization of surfactants may be effected before addition of the basic calcium compound used in the overbasing step or by means of the basic calcium compound.

Overbased detergents, which are normally prepared as concentrates in oil containing, for example, 50 to 70 mass % overbased detergent based on the mass of the concentrate, are useful as additives for oil-based compositions, for example, lubricants or greases. The amount of overbased detergent to be included in the oil-based composition depends on the type of composition and its proposed application: lubricants for marine applications typically contain 0.5 to 18 mass % of overbased detergent, on an active ingredient basis based on the final lubricant, while automotive crankcase lubricating oils typically contain 0.01 to 6 mass % of overbased detergent, on an active ingredient basis based on the final lubricant.

The overbased detergents prepared are oil-soluble or are dissolvable in oil with the aid of a suitable solvent, or are stably dispersible materials. Oil-soluble, dissolvable, or stably dispersible as that terminology is used herein does not necessarily indicate that the additives are soluble, dissolvable, miscible, or capable of being suspended in oil in all proportions. It does mean, however, that the additives are, for instance, soluble or stably dispersible in oil to an extent sufficient to exert their intended effect in the environment in which the oil is employed. Moreover, the incorporation in an oil-based composition of other additives may permit incorporation of higher levels of a particular additive, if desired.

The overbased detergents may be incorporated into a base oil in any convenient way. Thus, they may be added directly to the oil by dispersing or by dissolving them in the oil at the desired level of concentration, optionally with the aid of a suitable solvent such, for example, as toluene or cyclohexane. Such blending can occur at room temperature or at elevated temperature.

Synthetic base oils include alkyl esters of dicarboxylic acids, polyglycols and alcohols; poly-α-olefins, including polybutenes; alkyl benzenes; organic esters of phosphoric acids; and polysilicone oils.

Natural base oils include mineral lubricating oils which may vary widely as to their crude source, for example, as to whether they are paraffinic, naphthenic, mixed, or paraffinic-naphthenic, as well as to the method used in their production, for example, their distillation range and whether they are straight run or cracked, hydrofined, or solvent extracted.

Lubricating oil base stocks suitable for use in crankcase lubricants conveniently have a viscosity of about 2.5 to about 12 cSt, or $mm^2/s$, at 100° C., although base stocks with other viscosities may be used, for example, bright stock.

Lubricating oil base stocks suitable for use in marine lubricants conveniently have a viscosity of typically about 3 to about 15 cSt, or $mm^2/s$, at 100° C., although base stocks with other viscosities may also be used. Thus, for example, bright stocks, which typically have a viscosity of about 30 to 35 cSt, or $mm^2/s$, at 100° C. may be used.

Additional additives may be incorporated in the composition to enable it to meet particular requirements. Examples of additional additives which may be included in lubricating oil compositions containing an overbased detergent are viscosity index improvers, corrosion inhibitors, other oxidation inhibitors or antioxidants, friction modifiers, dispersants, other detergents, metal rust inhibitors, anti-wear agents, pour point depressants, and anti-foaming agents. Lubricating oils suitable for use in marine engines advantageously include a dispersant and an antiwear agent as additional additives and may also contain other additives, for example, additional antioxidants, antifoaming agents and/or rust inhibitors. Certain of the additional additives specified below are more appropriate for use in lubricants for automobile engines than for use in lubricants for marine engines.

The invention will now be described, by way of example only, with reference to the following examples:

EXAMPLES

The following five overbased calcium sulphonate detergents were prepared:

| | Ex 1 | Ex 2 | Ex 3 | Ex 4 | Ex 5 |
|---|---|---|---|---|---|
| Soap Content, % w | 22 | 22 | 25 | 25 | 23.9 |
| TBN, ASTM D2896 | 417 | 419 | 425 | 425 | 421 |
| $Vk_{100}$, cSt | 127 | 117 | 258 | 174 | 199 |
| $VK_{40}$, cSt | | 2014 | 4927 | 2039 | 3594 |
| Soap/BN | 0.0528 | 0.0525 | 0.0588 | 0.0588 | 0.0568 |
| Performance Tests | | | | | |
| Component Stability, aspect | | X | | X | X |
| Component stability, Vk | | X | | X | X |
| Catalytic Oxidation | X | X | X | | X |
| Hot Tube | X | X | X | | X |
| Caterpillar CMOT | X | X | X | | X |
| Ball Rust | X | X | X | | X |

The lubricating oil compositions in the Table below were prepared:

| | Oil 1 | Oil 2 | Oil 3 | Oil 4 | Oil 5 |
|---|---|---|---|---|---|
| Ex 1 | 2.50 | | | | |
| Ex 2 | | 2.50 | | | |
| Ex 3 | | | 2.50 | | |
| Ex 5 | | | | 2.50 | |
| Commercial 425BN calcium Sulphonate | | | | | 2.50 |
| SN600 from ExxonMobil | 97.50 | 97.50 | 97.50 | 97.50 | 97.50 |
| BN, ASTM D445, cSt | 10.61 | 10.66 | 10.79 | 13.72 | 10.60 |
| $Vk_{100}$, ASTM D445, cSt | 12.37 | 12.40 | 12.29 | 12.46 | 12.48 |
| Performance Tests | | | | | |
| Ball Rust, merit | 82 | 78 | 74 | 93 | 106 |
| Vk100 increase (%) | 114.9 | 91.2 | 60.6 | 50.3 | 84.8 |
| TAN increase | 5.3 | 4.1 | 2.9 | 1.9 | 3.4 |
| IR Oxidation | 137.1 | 113.4 | 88 | 81.7 | 107.8 |
| Caterpillar CMOT, Induction Time (mins) | 38 | 32 | 42 | 55 | 37 |

As shown in the Table above, Oil 4 (which includes the detergent from Ex 5) achieves the best results for Vk100 increase (%), TAN increase and IR Oxidation. Although Oil 5 (which includes the commercial sulphonate) achieves the best result for Ball Rust, it achieves poor results for Vk100 increase (%), TAN increase and IR Oxidation. Therefore, overall, Oil 4 (which includes the detergent from Ex 5) is the preferred oil.

| | Oil 6 | Oil 7 | Oil 8 | Oil 9 | Oil 10 |
|---|---|---|---|---|---|
| Ex 1 | 8.00 | | | | |
| Ex 2 | | 8.00 | | | |
| Ex 3 | | | 8.00 | | |
| Ex 5 | | | | 8.00 | |
| Commercial 425BN calcium Sulphonate | | | | | 8.00 |
| SN600 from ExxonMobil | 92.00 | 92.00 | 92.00 | 92.00 | 92.00 |
| BN, ASTM D445, cSt | 33.99 | 33.79 | 33.99 | 33.87 | 33.49 |
| $Vk_{100}$, ASTM D445, cSt | 12.80 | 12.42 | 12.94 | 12.86 | 13.05 |

-continued

| | Oil 6 | Oil 7 | Oil 8 | Oil 9 | Oil 10 |
|---|---|---|---|---|---|
| | Performance Test | | | | |
| Hot Tube, merit | 8.67 | 8.42 | 9.17 | 9.33 | 8.92 |

As shown above, Oil 9 (which includes the detergent from Ex 5) achieves the best results in the Hot Tube test.

The tests above show that the detergent from Example 5, which is in accordance with the present invention, is the preferred detergent.

What is claimed is:

1. A calcium sulphonate detergent having a total soap/BN ratio of 0.0530 to 0.0585, and a total base number of greater than 350 mg KOH/g as measured by ASTM D 2896-98; the calcium) sulphonate detergent being prepared from a surfactant system that includes greater than 90% of sulphonic acid.

2. The calcium sulfonate detergent as claimed in claim 1, wherein the calcium sulphonate detergent is prepared from a surfactant system that includes greater than 95% of sulphonic acid.

3. The calcium sulphonate detergent as claimed in claim 1, wherein the detergent has a total soap/BN ratio of 0.0540 to 0.0580.

4. The calcium sulphonate detergent as claimed in claim 1, wherein the detergent has a total soap/BN ratio of 0.0550 to 0.0575.

5. The calcium sulphonate detergent as claimed in claim 1, wherein the detergent has a total base number of greater than 400 mg KOH/g as measured by ASTM D 2896-98.

6. The calcium sulphonate detergent as claimed in claim 5, wherein the detergent has a total base number of greater than 420 mg KOH/g as measured by ASTM D 2896-98.

7. The method as claimed in claim 5, wherein the calcium sulphonate detergent has a total base number of greater than 400 mg KOH/g as measured by ASTM D 2896-98.

8. The method as claimed in claim 7, wherein the calcium sulphonate detergent has a total base number of greater than 420 mg KOH/g as measured by ASTM D 2896-98.

9. A lubricating oil composition including the high base number calcium sulphonate detergent as claimed in claim 1.

10. A method of reducing the viscosity drift of a calcium sulphonate detergent, the method including the step of controlling the total soap and base number of the detergent so that the total soap/base number is 0.0530 to 0.0585; the detergent having a total base number of greater than 350 mg KOH/g as measured by ASTM D 2896-98; the calcium sulphonate detergent being prepared from a surfactant system that includes greater than 90% of sulphonic acid.

11. The method as claimed in claim 10, wherein the calcium sulphonate detergent is prepared from a surfactant system that includes greater than 95% of sulphonic acid.

12. The method as claimed in claim 5, wherein the total soap/base number is 0.0540 to 0.0580.

13. The method as claimed in claim 12, wherein the total soap/base number is 0.0550 to 0.0575.

* * * * *